United States Patent [19]

Pryor et al.

[11] 4,361,445

[45] Nov. 30, 1982

[54] COPPER ALLOY CLEANING PROCESS

[75] Inventors: Michael J. Pryor, Woodbridge; Murray A. Heine, Hamden; Andrew J. Brock, Cheshire, all of Conn.

[73] Assignee: Olin Corporation, New Haven, Conn.

[21] Appl. No.: 277,762

[22] Filed: Jun. 26, 1981

Related U.S. Application Data

[63] Continuation of Ser. No. 104,244, Dec. 17, 1979, abandoned, which is a continuation-in-part of Ser. No. 941,890, Sep. 13, 1978, abandoned.

[51] Int. Cl.[3] ..... C23G 1/02; C23G 1/14

[52] U.S. Cl. ..... 134/3; 134/28; 134/29; 134/30; 134/41

[58] Field of Search ..... 134/2, 3, 28, 29, 30, 134/41

[56] References Cited

U.S. PATENT DOCUMENTS

| | | | |
|---|---|---|---|
| 947,067 | 1/1910 | Thompson | 134/28 |
| 2,295,204 | 9/1942 | Dockray | 134/28 |
| 2,318,559 | 5/1943 | Percival | 134/28 |
| 3,433,720 | 3/1969 | Kupsis et al. | 134/28X |
| 3,646,946 | 3/1972 | Ford et al. | 134/3 |

OTHER PUBLICATIONS

Dettner/Elze-Handbuch der Galvano-Technik; vol. I/2-C. Hanser Verlag, 1964 Munich (DE) * p. 772*.

*Primary Examiner*—Marc L. Caroff

*Attorney, Agent, or Firm*—Barry L. Kelmachter; Paul Weinstein; Howard M. Cohn

[57] ABSTRACT

A rapid and effective surface cleaning process for copper alloys, particularly copper alloys containing aluminum and other metals tending to form surface coatings of refractory oxides during annealing treatments, consists of treating such alloys or articles fabricated thereof for a short time in a hot aqueous solution of an alkali hydroxide, rinsing with water, and then immersing for a short time in a hot aqueous solution of ferric sulfate, or other ferric salt of a mineral acid, followed by rinsing with water.

10 Claims, No Drawings

COPPER ALLOY CLEANING PROCESS

CROSS REFERENCE TO RELATED APPLICATIONS

This application is a continuation of U.S. application Ser. No. 104,244, filed Dec. 17, 1979, by Michael J. Pryor et al. for Copper Alloy Cleaning Process, now abandoned, which in turn is a continuation-in-part of U.S. application Ser. No. 941,890, filed Sept. 13, 1978, by Michael J. Pryor et al. for Copper Alloy Cleaning-Process, now abandoned.

BACKGROUND OF THE INVENTION

This invention relates to the surface cleaning of copper base alloys and provides a rapid and effective two-stage process for removing surface oxide deposits formed on the metal, as during annealing treatments. In the case of copper alloys containing aluminum and other readily oxidizable metals such as iron, cobalt, nickel, zinc, or silicon, a resistant metal oxide surface film is formed during annealing treatments at elevated temperatures, applied for a period of time sufficient to relieve strains imposed during mechanical operations, as in the rolling of metal ingots to elongated strip of reduced thickness or for the fabrication of metal parts and articles. Such surface coatings of oxide are produced even when the annealing is carried out in the presence of a protective atmosphere, such as may be prepared by the partial combustion of a hydrocarbon, because the active metals present in the alloy will react with oxygen that is present in the free state or as moisture or as an oxide of carbon to form refractory oxides. When various metal oxides are thus formed, they often tend to combine with each other to form complex metal oxides, such as spinels, of refractory nature, which at times are extremely resistant to removal by conventional cleaning methods. Unless such surface oxide films are thoroughly removed, however, subsequent surface finishing treatments, such as soldering, electroplating, or pressure bonding with other metals, will generally yield unsatisfactory results because of the resulting poor adhesion.

While numerous proposals have been made in the past for single and multi-stage cleaning treatments, they have generally proved ineffective for the successful cleaning of copper alloys containing aluminum and other metals tending to form refractory oxides in thick surface layers. Although some of these procedures may, if prolonged, finally result in the removal of such layers, an undesirable extent of pitting and etching of the metal surface is found to occur simultaneously during such extended treatments, which may render them unsuitable for the intended purpose. Such unsatisfactory results characterize attempts to remove thick refractory oxide layers from various copper alloys containing aluminum and other active metals by single treatments with aqueous pickling solutions, such as aqueous solutions of sulfuric acid, sulfuric acid and alkali dichromate, sulfuric acid and ferric sulfate, as described on Pages 308–309 of "The Chemical Formulary", Vol. IX, 1951, Chemical Publishing Co., Inc., Brooklyn, N.Y.

Accordingly, it is the principal object of this invention to provide a rapid and effective treatment for the removal of refractory complex metal oxide films, even of unusually high thickness, from the surface of copper base alloys.

A further object is to provide a process that is readily applied and is effective for such removal without causing harmful surface etching or pitting of the metal.

Other objectives and advantages will be apparent from the following description.

SUMMARY OF THE INVENTION

In accordance with the present invention, the foregoing and other objectives are readily attained by the combination of the following two-step treatment, neither step alone being effective to produce a clean metal surface satisfactory for soldering or other surface treating process. The oxide-coated copper-base article or strip is first immersed in a stirred aqueous alkaline solution, as of sodium, potassium or lithium hydroxide, having a pH above 10, for at least two seconds at a temperature of about 40° C. to the boiling point, and, after draining and rinsing with water, is then submerged in a stirred aqueous solution of ferric sulfate, or similar ferric salt of a mineral acid, at a ferric salt concentration of 0.5 to 3.0 N, for at least two seconds, preferably for five to sixty seconds, at a temperature of 25° to 95° C., preferably at 60° to 90° C. Each step should be followed by draining the solution from the article or subjecting it to blowing with air streams, and removing the residual solution by rinsing with water.

The need for such improved cleaning process arose during the use of the duplex process of U.S. Pat. No. 3,646,946 issued Mar. 7, 1972, consisting of first immersing annealed metal in a hot alkaline solution and then treating with a hot solution of mineral acid, preferably a 12% by volume aqueous sulfuric acid solution. Effective results were attained thereby in removing complex oxide films and producing a surface displaying excellent solderability in a variety of annealed copper base alloys, such as Cu, Fe and Al; Cu, Al, Si, Co and P; and C.D.A. Alloy 688 containing 22.7% Zn, 3.4% Al, 0.4% Co, and balance essentially Cu. The above duplex treatment accomplished the substantially complete removal of complex oxide film in annealed metal shown by capacitance measurements to have surface oxide films up to about 105 Å in thickness. However, when the latter alloy was annealed under more severe conditions and having surface oxide films up to 140 to 160 Å in thickness, such as resulted from bell annealing treatments which were prolonged or carried out in a less protective atmosphere, the above duplex cleaning process displayed substantially decreased effectiveness. Thereby, the need for an improved cleaning procedure arose as an urgent problem, which has now been solved through the provision of the novel second step of the duplex treatment described below.

DETAILED DESCRIPTION

It was theorized that a solution having proper oxidative power and solvent action on complex oxide films might be found through measurements of the rate of weight loss of the basis metal therein. This mode of attack has been successful in establishing an effective second treatment, although the generality of such parallel behavior is quite uncertain and unproved. A study of weight loss measurements was carried out in the above Alloy 688 at 50° C. and 65° C. immersed for periods of 10, 20, and 30 seconds in a 1 N. aqueous solution of ferric sulfate containing no added acid, and comparison solutions containing 1 N. ferric sulfate and added sulfuric acid at concentrations of 1 N., 3 N., and 5 N. At each temperature, the loss in weight per unit area, expressed as micrograms per square centimeter, was linear with time, in seconds, and yielded the values for dissolving rate listed in Table I.

TABLE I

| Solution | Dissolving Rate ($\mu$ grams per $cm^2$ per sec.) 50° C. | 65° C. |
|---|---|---|
| 1 N.$Fe_2(SO_4)_3$ | 45.0 | 62.8 |
| 1 N.$Fe_2(SO_4)_3$ + 1 N.$H_2SO_4$ | 44.4 | 58.0 |
| 1 N.$Fe_2(SO_4)_3$ + 3 N.$H_2SO_4$ | 41.3 | 53.8 |
| 1 N.$Fe_2(SO_4)_3$ + 5 N.$H_2SO_4$ | 36.4 | 48.3 |

These results showed quite unexpectedly that the aqueous ferric sulfate solution with no added acid, at both temperatures, dissolves the metal at a higher rate than any of the solutions containing added acid, and further, that the dissolving rate at both temperatures decreases as the concentrations of added acid is increased.

It was subsequently shown in duplex cleaning treatments of annealed metal having a surface oxide film up to 160 A thick, wherein the treatment consisted of a first immersion in a hot alkaline solution, followed by a second immersion in a hot ferric sulfate solution containing no added acid, that the removal of oxide film was accomplished effectively, as substantiated by the applicable tests, including the solderability test. The cleaning action is as thorough and complete, or better, than when added sulfuric acid is present in the ferric sulfate solution, thereby accomplishing at least equivalent results more conveniently and at decreased expense.

The initial treatment with hot alkaline solution is carried out at a temperature of about 40° C. to the boiling point and preferably, at a temperature of about 70° C. to the boiling point, the solution having a pH above 10, preferably 11 to 14. The solution is preferably of caustic soda, but other alkali hydroxides as of potassium or lithium, or mixtures may be used within the above-stated pH range. Immersion of the copper alloy should be for at least two seconds and preferably, for five to sixty seconds. The treatment time may be prolonged, particularly at temperatures near the lower limit of the above range, but generally should be for ten minutes or less, as longer times usually provide no added advantages. Optimum treating times and conditions may be determined in accordance with the particular alloy and the results desired.

The second step of the duplex treatment is best effected by immersion of the copper alloy strip or article, after the alkaline solution has been drained therefrom and rinsed with water, in a hot 0.5 to 3 N., best 1.25 to 2 N., solution of ferric sulfate, without added acid at a temperature of about 25° to 95° C., best 65° to 90° C., for at least two seconds, and preferably for five to sixty seconds, and generally for not over ten minutes.

Ferric sulfate for such treatment may be replaced in whole or in part by other soluble ferric salts, as for example by ferric ammonium sulfate or ferric nitrate, generally with the obtainment of equivalent results in the obtainment of clean and solderable copper alloy surfaces. It may be noted that aqueous solutions of ferric sulfate, typical of soluble ferric salts of strong acids, display a pH of about 1 at 0.5 N. solution, decreasing, close to linearly, to about 0.5 at 2 N. and to about 0.35 at 3 N.

The efficacy of a duplex treatment in accordance with this invention, as above outlined, is illustrated in the following specific example, contrasting its successful results with the ineffective cleaning provided by the process taught in U.S. Pat. No. 3,646,946, the closest prior art duplex treatment.

EXAMPLE I

Sheets of C.D. Alloy 688 (containing 22.7% Zn, 3.4% Al, 0.4% Co, and balance essentially Cu) were bell annealed at about 600° C. in a closed furnace containing an atmosphere produced by the partial combustion of hydrocarbons to produce two lots of annealed sheet, the first having a surface oxide layer ranging 95 to 105 Å in thickness and the second having a surface oxide layer ranging 140 to 160 Å in thickness.

Samples of the two lots were given a first immersion treatment in boiling caustic soda solution having a pH of 14 for twenty seconds, drained, and washed with water.

Samples of the two lots, treated as above, were then subjected to immersion for twenty seconds in one of the following three solutions:

(1) 1.5 N. aqueous ferric sulfate solution, containing no added acid, at 65° C.

(2) 12% by vol. aqueous sulfuric acid solution at 65° C.

(3) 12% by vol. aqueous sulfuric acid solution containing 4 oz. per gallon of sodium dichromate.

Following the twenty second immersion, the samples were drained, washed with water, and dried.

Solderability tests applied to the treated samples of the first lot (95 to 105 Å oxide layer) revealed that those treated with solution (1) and (3) were solderable, while those treated with solution (2) could not be soldered effectively.

Solderability tests applied to the treated samples of the second lot (140 to 160 A oxide layer) revealed that those treated with solution (1) were solderable, while those treated with solutions (2) and (3) could not be effectively soldered.

Furthermore, capacitance tests on the above-treated samples revealed that the oxide layer had been substantially completely removed from the samples which displayed acceptable solderability [Lot 1, treated with (1) or (3)] and [Lot 2, treated with (1)]. The samples which were not solderable [Lot 1, treated with (2)] and [Lot 2, treated with (2) and (3)] were determined to have retained about 20 to 30% of the initial oxide layer.

Thus, the only duplex treatment which was completely successful in the above example was the one utilizing for the second treatment the immersion in aqueous ferric sulfate solution with no added acid.

The above test for solderability corresponds to that described in Report W 72 - 51.2, American Society for Metals, Metals Park, Ohio. The sample is immersed in a rosin flux solution, then vertically dipped into a 60 Sn: 40 Pb molten solder at 230° C., held in the bath for five seconds, withdrawn, and examined after cooling. The coating is rated according to appearance, ranging from "ideal" for a bright, smooth deposit of uniform thickness to that in which there has been no solder adherence to the metal surface.

The capacitance test referred to above has been described by J. J. McMullen and M. J. Pryor in "First International Congress in Metallic Corrosion", pages 53-54, 1961 (Butterworth's, London), as amplified by Beck, Heine, Keir, van Rooyen, and Pryor in "International Journal of Corrosion Science", Vol. 2, pages 136 and 144-145, 1962.

EXAMPLE II

Samples of CDA Alloy 688 having essentially the same nominal composition as in Example I and having a surface oxide layer of approximately 150 Å in thickness were treated as follows:

All samples were given a first immersion treatment for 15 seconds in a boiling solution comprising 1 N. sodium hydroxide and thereafter drained and washed with water. The samples treated as above were then divided into three lots. The samples from the first lot were immersed in a 2 N. aqueous ferric sulfate solution containing no added acid, at 65° C. Samples from the first lot were withdrawn from the ferric sulfate solution after respective time intervals of 5, 10, 15, 20 and 25 seconds and then drained, washed with water and dried.

The samples from the second lot were immersed in a 2 N. ferric sulfate solution containing 3 N. sulfuric acid at 65° C. These samples were also withdrawn from the solution after respectively different time intervals from 5 to 25 seconds as in accordance with the previous lot and then drained, washed with water and dried.

The third lot of samples were immersed in a 2 N. ferric sulfate solution containing 5 N. $H_2SO_4$ at 65° C. These samples were removed after respective time intervals in accordance with the previous lots and then drained, washed with water and dried. The results are summarized in Table II.

TABLE II

| Solution | Sample Lot | Removal Rate (μ grams per cm² per sec.) 65° C. |
|---|---|---|
| 2 N.$Fe_2(SO_4)_3$ | 1 | 86.9 |
| 2 N.$Fe_2(SO_4)_3$ + 3 N.$H_2SO_4$ | 2 | 74.4 |
| 2 N.$Fe_2(SO_4)_3$ + 5 N.$H_2SO_4$ | 3 | 66.9 |

The loss in weight per unit area for each sample lot was linear with time of immersion. These results verify that the effect of added mineral acid on the potency of the ferric sulfate cleaning bath as demonstrated in Table I is also applicable to alloys with the oxide coating. These results show that the aqueous ferric sulfate solution with no added acid removes the oxide layer at a higher rate than similar solutions containing added acid. Further, this example verifies that the removal rate decrease as the concentration of added acid increases. Therefore, it is an important aspect of this invention that the ferric sulfate bath have no added mineral acid to thereby provide improved cleaning efficiency.

EXAMPLE III

In order to further evidence the synergistic results obtained by the process of this invention samples of CDA Alloy 688 having the same nominal composition as in Example I and having an oxide layer of 150 A in thickness were treated as follows:

Sample 1 was immersed for 20 seconds in a boiling 1 N. NaOH solution and the weight loss per square centimeter measured. Thereafter, Sample 1 was subjected to immersion for 20 seconds in a 12% by volume aqueous sulfuric acid solution at 50° C. and the further weight loss per unit area measured.

Sample 2 was subjected to immersion for 20 seconds in a 1.5 N. aqueous ferric sulfate solution containing no added acid, at 65° C. and the weight loss per unit area measured.

Sample 3 was subjected first to an immersion for 20 seconds in a boiling 1 N. NaOH solution and its weight loss per unit area measured. Thereafter, Sample 3 was immersed for 20 seconds in a 1.5 N. aqueous ferric sulfate solution containing no added acid at 65° C. and the further weight loss per unit area measured.

For each of the samples noted above following the immersion the samples were drained, washed with water and dried.

The results of these tests are summarized in Table III.

TABLE III

| Sample No. | Process | Weight loss per unit area (μ grams per cm²) |
|---|---|---|
| 1 | after immersion in NaOH solution | 11 |
| 1 | after immersion in $H_2SO_4$ solution | 16.6 |
| | | Total 27.6 |
| 2 | after immersion in $Fe_2(SO_4)_3$ solution | Total 267 |
| 3 | after immersion in NaOH solution | 17 |
| 3 | after immersion in $Fe_2(SO_4)_3$ solution | 1349 |
| | | Total 1366 |

These results clearly illustrate the synergistic behavior exhibited by the process in accordance with this invention. The results which are reported in weight loss per unit area clearly demonstrate that the process of this invention as applied to Sample 3 is considerably more effective in removing the oxide layer than either a ferric sulfate solution alone as applied to Sample 2 or the previously known duplex process as applied to Sample 1. The marked improvement in removal rate for the process of this invention could hardly be expected from the removal rates obtained with the processes of the prior art as applied to Samples 1 and 2.

The mechanism of the duplex cleaning treatment of this invention is believed to differ in a significant way from the mechanism of the duplex cleaning treatment of U.S. Pat. No. 3,646,946. The first treatment in the aqueous alkaline solution is believed to hydrolyze the refractory oxides to convert them to a gelatinous condition. In the patented process the immersion in the mineral acid solution serves to remove the copper oxides without significant metal removal. In the process of the present invention the immersion in the ferric sulfate solution provides a cleaning action through removal of underlying metal beneath the oxide which undermines the oxide layer. The gelatinous condition of the oxide layer from the alkaline treatment allows the ferric sulfate solution to penetrate to the metal surface to provide the metal removal.

It has been observed for certain silicon containing copper alloys that an oxide penetration of from about 6 to 10 microns occurs at the grain boundaries. The prior art duplex treatment is not effective to remove the oxides at the grain boundaries because of insufficient removal of the adjacent metal. The process of this invention is highly effective for removing such grain boundary oxides because it attacks the metal surface. The process of this invention is designed to remove oxides which are insoluble or resistant to normal pickling agents including ferric sulfate.

The invention may be embodied in other forms or carried out in varied ways without departing from the spirit or essential characteristics thereof. The present embodiment is therefore to be considered as illustrative, the scope of the invention being indicated by the appended claims and all changes and variations which come within the meaning and range of equivalency are intended to be embraced therein.

What is claimed is:

1. A process for cleaning the surface of a copper base alloy having a surface layer of thermally formed complex metal oxide of a refractory nature which is resistant to ferric sulfate, said process comprising immersing the said surface in an aqueous alkaline solution having a pH of 11 to 14 and heated to a temperature of about 40° C. to its boiling point for a period of two seconds to not more than ten minutes, and then immersing the said surface in 0.5 to 3 N. aqueous solution of ferric sulfate containing no added mineral acid at a temperature of 25° C. to 95° C. for a period of two seconds to not more than five minutes, said process being adapted to remove said surface layer from the copper base alloy surface when said surface layer has a thickness up to at least 160 Å.

2. A process according to claim 1 wherein said alloy contains Al and at least one metal selected from the group consisting of Zn, Fe, Co and Si.

3. A process according to claim 1 wherein said thermal oxide layer has a thickness of 140 to 160 Å.

4. A process according to claim 1 wherein said alkaline solution is at 70° C. to its boiling point.

5. A process according to claim 1 wherein said alloy contains silicon and wherein said ferric sulfate solution is effective to remove oxides at grain boundaries of said alloy by attacking said alloy.

6. A process according to claim 1 wherein said ferric sulfate solution is at 60° to 90° C.

7. A process according to claim 1 wherein said surface is immersed in said alkaline solution for a period of five to sixty seconds.

8. A process according to claim 1 wherein said surface is immersed in the said ferric sulfate solution for a period of five to sixty seconds.

9. A process according to claim 1 wherein said ferric sulfate solution has a pH of 0.35 to 1.

10. A process according to claim 1 wherein said aqueous solution of ferric sulfate is from 1.25 to 2 N.

* * * * *